US010700463B2

(12) United States Patent
Yanagibashi et al.

(10) Patent No.: US 10,700,463 B2
(45) Date of Patent: Jun. 30, 2020

(54) CONNECTOR

(71) Applicant: YAZAKI CORPORATION, Tokyo (JP)

(72) Inventors: Kouji Yanagibashi, Shizuoka (JP); Naoto Ikeya, Shizuoka (JP); Yoshitaka Tsushima, Shizuoka (JP); Masaya Okamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/352,782

(22) Filed: Mar. 13, 2019

(65) Prior Publication Data

US 2019/0305462 A1 Oct. 3, 2019

(30) Foreign Application Priority Data

Mar. 27, 2018 (JP) ..... 2018-060354

(51) Int. Cl.
*H01R 13/436* (2006.01)
*H01R 13/506* (2006.01)
*H01R 13/58* (2006.01)

(52) U.S. Cl.
CPC ..... *H01R 13/4367* (2013.01); *H01R 13/506* (2013.01); *H01R 13/582* (2013.01); *H01R 2201/26* (2013.01)

(58) Field of Classification Search
CPC ..... H01R 13/4367; H01R 13/506; H01R 13/582; H01R 2201/26
See application file for complete search history.

(56) References Cited

U.S. PATENT DOCUMENTS 5,611,712 A * 3/1997 Morishita ..... H01R 13/4367 439/752
6,250,952 B1 * 6/2001 Shiga ..... F42B 3/188 439/466
10,389,056 B2 * 8/2019 Suzuki ..... H01R 13/447
2002/0173205 A1 * 11/2002 Kato ..... H01R 13/4367 439/752

(Continued)

FOREIGN PATENT DOCUMENTS

EP 2 955 796 A1 12/2015
JP 2015-8099 A 1/2015

(Continued)

OTHER PUBLICATIONS

Extended European search report for the related European patent application No. 19162756.1 dated Jun. 25, 2019.

*Primary Examiner* — Oscar C Jimenez
(74) *Attorney, Agent, or Firm* — Kenealy Vaidya LLP

(57) ABSTRACT

A connector includes a terminal configured to be connected to a mating terminal, and having an electric wire led out in a direction orthogonal to a connection direction in which the terminal is connected to the mating terminal, a housing having a cavity part configured to accommodate the terminal, and a rear holder having a terminal holding part configured to hold the terminal. The terminal is accommodated in the cavity part when the rear holder is assembled to the housing. The rear holder includes a locking mechanism that locks the terminal or the electric wire and that maintains a state of the terminal being held in the terminal holding part.

2 Claims, 13 Drawing Sheets

(56) References Cited

U.S. PATENT DOCUMENTS

| | | | | |
|---|---|---|---|---|
| 2004/0192103 | A1* | 9/2004 | Lee | H01R 12/675 439/404 |
| 2004/0235364 | A1* | 11/2004 | Matsumoto | B60L 50/72 439/752 |
| 2013/0137310 | A1* | 5/2013 | Genau | H01R 13/6471 439/660 |
| 2013/0164996 | A1* | 6/2013 | Miyakawa | H01R 13/111 439/694 |
| 2015/0147918 | A1* | 5/2015 | Matsuda | H01R 13/5841 439/694 |
| 2015/0258905 | A1* | 9/2015 | Fukushima | H01R 13/506 439/34 |
| 2016/0006156 | A1* | 1/2016 | Shimizu | H01R 4/72 439/310 |
| 2016/0072213 | A1 | 3/2016 | Ichio et al. | |
| 2016/0126681 | A1 | 5/2016 | Kawai et al. | |
| 2016/0359258 | A1 | 12/2016 | Koester | |
| 2018/0019535 | A1* | 1/2018 | Uenosono | H01R 13/426 |
| 2018/0358731 | A1* | 12/2018 | Endo | H01R 13/50 |

FOREIGN PATENT DOCUMENTS

| | | | |
|---|---|---|---|
| JP | 2016-225298 | A | 12/2016 |
| JP | 2017-152105 | A | 8/2017 |
| WO | 2014/147761 | A1 | 9/2014 |

* cited by examiner

CONNECTOR

CROSS REFERENCE TO RELATED APPLICATIONS

This application is based on Japanese Patent Application (No. 2018-060354) filed on Mar. 27, 2018, the contents of which are incorporated herein by reference.

BACKGROUND OF THE INVENTION

1. Field of the Invention

The present invention relates to a connector.

2. Description of the Related Art

There has been known a connector including a holder (rear holder) that is fitted into a housing and supports an electric wire connected to a terminal accommodated in the housing (see JP-A-2015-8099). The holder includes a first holder having a locking part, and a second holder with which the first holder clamps the electric wire by having a part to be locked at the locking part.

Further, there has been known a plug insert, including: a holding block member that has an opening part opening to an outer side of a circumference; a contact member that is inserted into the opening part of the holding block member from the outer side of the circumference; and a fixing sleeve that is fitted onto the holding block member where the contact member is inserted into the opening part (see JP-A-2016-225298).

The structure of the connector disclosed in JP-A-2015-8099 is complicated because the holder that supports the electric wire connected to the terminal mounted in the housing is divided into the first holder and the second holder. For this reason, there is a problem that the assembling workability is not good.

In the plug insert disclosed in JP-A-2016-225298, the contact member that is inserted into the opening part of the holding block member is held by fitting the fixing sleeve onto the holding block member. For this reason, there is a possibility that the contact member comes off from the opening part of the holding block member, before the fixing sleeve is fitted onto the holding block member that is in a subassembly state where the contact member is inserted into the opening part. As a result, complicated assembling operations are requested that the contact member is inserted into a hole formed in a fixing block to be held so as not to come off from the holding block member and the fixing sleeve is assembled onto the holding block member.

SUMMARY OF THE INVENTION

The present invention has been made in view of the above circumstances, and an object thereof is to provide a connector capable of preventing defective assembly and improving assembling workability.

In order to achieve the above objects, the connector according to the invention is characterized by the following (1) to (4).

(1) A connector includes:

a terminal configured to be connected to a mating terminal, and having an electric wire led out in a direction orthogonal to a connection direction in which the terminal is connected to the mating terminal;

a housing having a cavity part configured to accommodate the terminal; and a rear holder having a terminal holding part configured to hold the terminal, wherein the terminal is accommodated in the cavity part when the rear holder is assembled to the housing; and wherein the rear holder includes a locking mechanism that locks the terminal or the electric wire and that maintains a state of the terminal being held in the terminal holding part.

(2) The connector according to (1), wherein the terminal has a first terminal and a second terminal; and wherein the terminal holding part has:

a first terminal holding part that is provided on an assembling side of the rear holder to be assembled to the housing and has an accommodating recess part into which the first terminal is fitted; and a second terminal holding part that has an accommodating recess part into which the second terminal is fitted in a direction orthogonal to the connection direction.

(3) The connector according to (2), wherein the locking mechanism includes a first locking mechanism that locks the first terminal fitted into the first terminal holding part, and a second locking mechanism that locks the second terminal fitted into the second terminal holding part, wherein the first locking mechanism includes a locking protrusion that locks the electric wire extending from the first terminal; and wherein the second locking mechanism includes:

a locking convex part that is engaged with a notch part provided in the second terminal in a direction orthogonal to the connection direction; and a pressing part that presses a rear part of the second terminal in a direction in which the second terminal is fitted to the accommodating recess part of the second terminal holding part.

(4) The connector according to (2) or (3), wherein the first terminal holding part has a first electric wire accommodating groove that accommodates the electric wire extending from the first terminal, and the second terminal holding part has a second electric wire accommodating groove that accommodates another electric wire extending from the second terminal.

According to the connector as configured in the above (1), the terminal is maintained in a state of being held in the terminal holding part. Therefore, the rear holder can be assembled to the housing with the terminal held in the terminal holding part. Moreover, when the rear holder is fitted to the housing, coming-off of the terminal from the rear holder can be prevented. Thus, the terminal can be held without backlash, and assembling workability can be improved. Further, holding state of the terminal in the terminal holding part can be observed visually, and the defective assembly can be easily prevented. Moreover, since the terminal is held in the rear holder along the direction in which the terminal is connected to the mating terminal, orthogonal to the direction in which the electric wire is led out, the electric wire that extends from the terminal does not get entangled with another electric wire, and the terminal can be held in the terminal holding part of the rear holder.

Further, according to connector as configured in the above (2), by fitting the first terminal into the accommodating recess part of the first terminal holding part and fitting the second terminal into the accommodating recess part of the second terminal holding part, the first terminal and the second terminal can be easily held in the rear holder.

Particularly, since the accommodating recess part of the first terminal holding part is formed on the mounting side of the rear holder to be mounted on the housing, a force, which acts on first terminal toward a rear side in the direction in which the first terminal is connected to the mating terminal, can be received by the rear holder.

According to the connector as configured in the above (3), the first terminal can be easily held in the rear holder by locking the electric wire that extends from the first terminal using the locking protrusion of the first locking mechanism. Further, the locking convex part of the second locking mechanism is engaged with the notch part of the second terminal, and the rear part of the second terminal is pressed by the pressing part in the direction in which the second terminal is fitted to the accommodating recess part of the second terminal holding part, so that the second terminal can be easily and securely held in the rear holder.

According to the connector as configured in the above (4), since the electric wires that extend from the first terminal and the second terminal are accommodated in the first electric wire accommodating groove and the second electric wire accommodating groove respectively, stagnation of the assembling operations due to stretching of the electric wire is eliminated and even better assembling workability can be ensured.

According to the invention, a connector is provided that is capable of preventing defective assembly and improving assembling workability.

The invention has been briefly described as above. Further, details of the invention will be clarified by reading a mode (hereinafter, referred to as "embodiment") for carrying out the invention to be described below with reference to attached drawings.

BRIEF DESCRIPTION OF THE DRAWINGS

FIGS. 6A and 6B are views for illustrating the rear holder, in which FIG. 6A is a perspective view of the rear holder when viewed from a front side and FIG. 6B is a perspective view of the rear holder when viewed from a rear side.

FIGS. 9A and 9B are views illustrating an accommodated state of the second terminal in the accommodating recess part of the second terminal holding part, in which FIG. 9A is a rear view of the accommodating recess part and FIG. 9B is a top view of the accommodating recess part.

DETAILED DESCRIPTION OF THE EXEMPLARY EMBODIMENTS

Hereinafter, embodiments according to the invention will be described with reference to the drawings.

Figure 1:
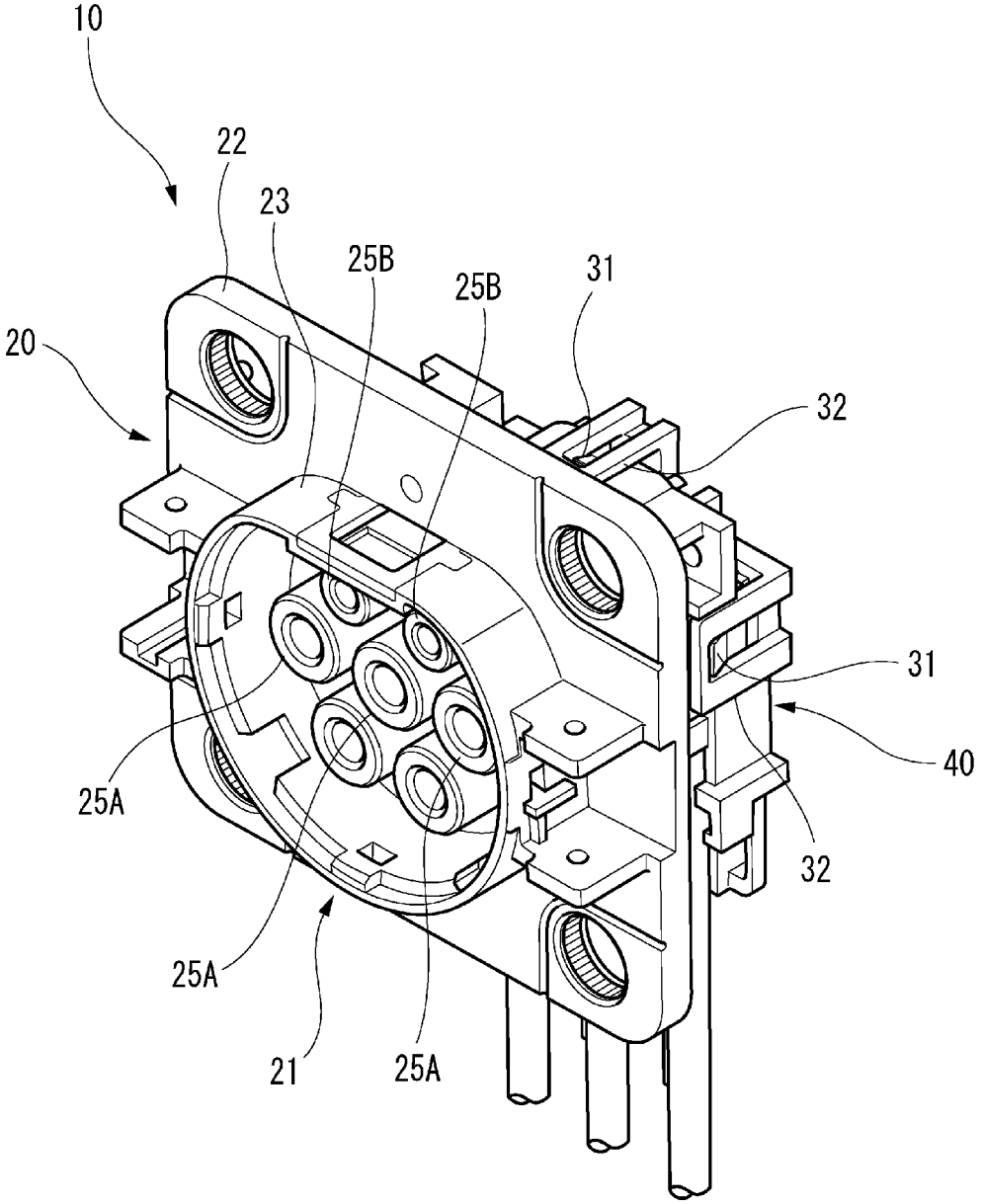
FIG. 1 is a perspective view of a connector when viewed from a front side according to an embodiment.
Figure 2:
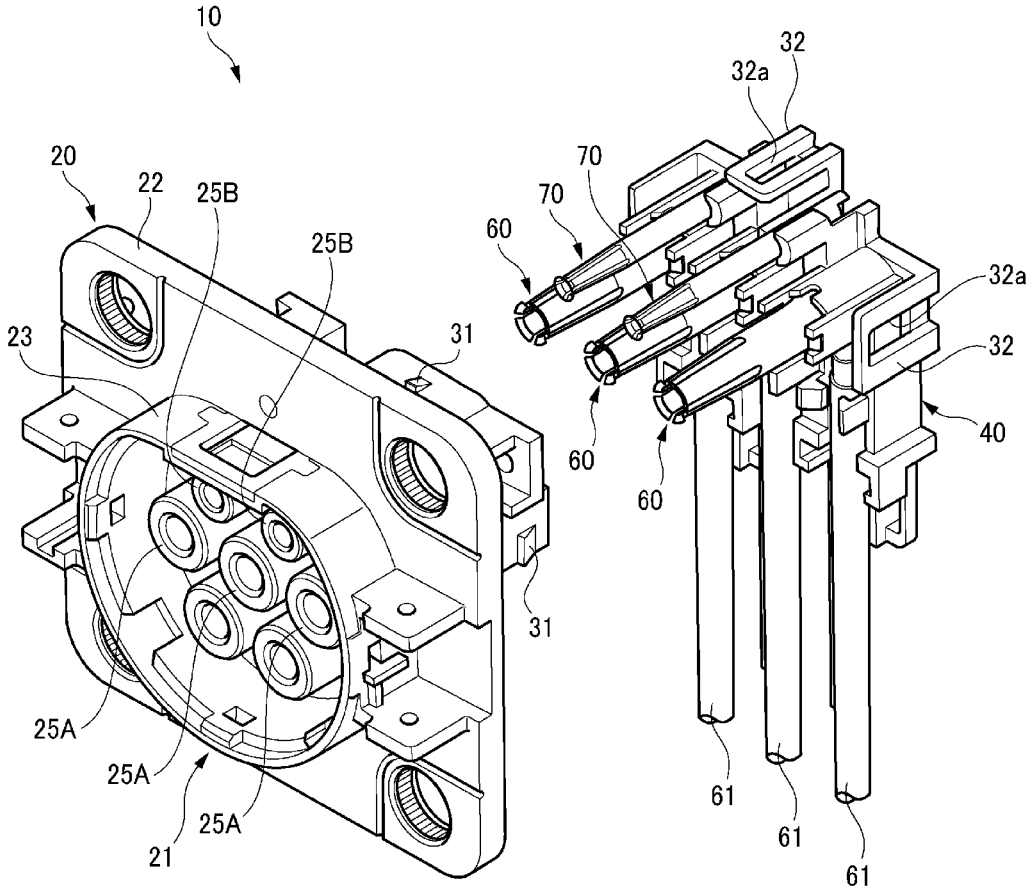
FIG. 2 is a perspective view of a housing and a rear holder when viewed from a front side.
Figure 3:
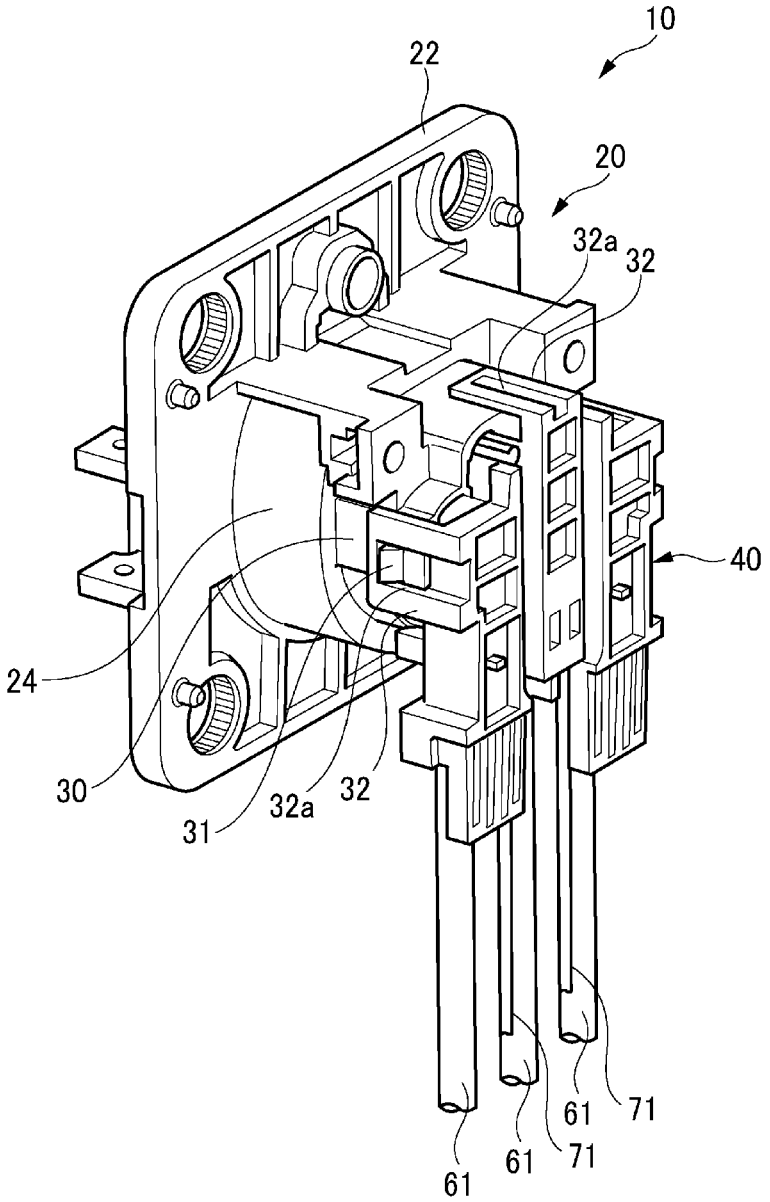
FIG. 3 is a perspective view of the connector when viewed from a rear side according to the embodiment.
Figure 4:
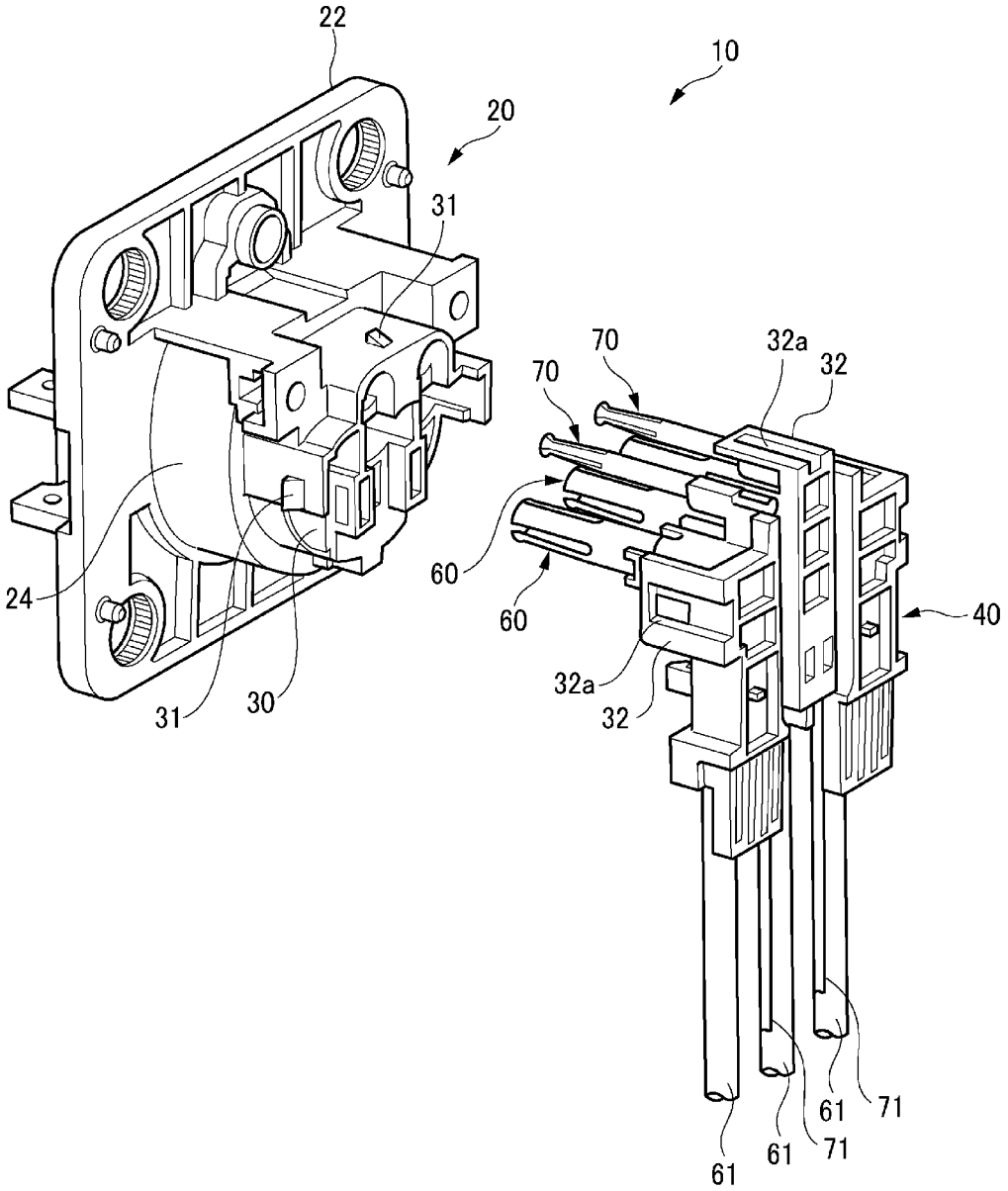
FIG. 4 is a perspective view of the housing and the rear holder when viewed from a rear side according to the embodiment.

FIG. 1 is a perspective view of a connector when viewed from a front side according to an embodiment. FIG. 2 is a perspective view of a housing and a rear holder when viewed from a front side. FIG. 3 is a perspective view of the connector when viewed from a rear side according to the embodiment. FIG. 4 is a perspective view of the housing and the rear holder when viewed from a rear side.

As illustrated in FIG. 1 to FIG. 4, a connector 10 according to the embodiment includes a housing 20, a rear holder 40, first terminals 60 and second terminals 70. The first terminals 60 are power supply terminals and are connected to end portions of power supply wires 61 respectively, and the second terminals 70 are signal terminals and are connected to end portions of signal wires 71 respectively.

The connector 10 according to the embodiment, for example, is mounted on a vehicle as a vehicle side connector to which a charging connector (mating connector) is fitted. Of course, the connector according to the embodiment may be used as a charging connector. Hereinafter, the connector will be described as a vehicle side connector (vehicle inlet) in the embodiment.

The housing 20 is molded by synthetic resin and has a mating connector fitting part 21. The charging connector or the like (not shown) is fitted with the mating connector fitting part 21 of the housing 20. The housing 20 has a quadrangular flange part 22 that is fitted to a fitting hole (not shown) of a vehicle. In the flange part 22, a hood part 23 in a cylindrical shape is provided in a protruding manner on a side of the mating connector fitting part 21. Also, in the flange part 22, a terminal mounting part 24 is provided in a protruding manner on a side opposite to the hood part 23. The rear holder 40 is mounted on the terminal mounting part 24.

The hood part 23 of the housing 20 is formed in the cylindrical shape, and a plurality of first cavity parts 25A and a plurality of second cavity parts 25B are provided inside the hood part 23. In each of the first cavity parts 25A, the first terminal 60 is accommodated from a side of the terminal mounting part 24, and in each of the second cavity parts 25B, the second terminal 70 is accommodated from the side of the terminal mounting part 24.

In the housing 20, the charging connector or the like is fitted to the mating connector fitting part 21 from a front side. By fitting the charging connector to the housing 20, power supply terminals of the charging connector are inserted into the first cavity parts 25A respectively, and, accordingly, the first terminals 60 and the power supply terminals of the charging connector are connected electrically. Similarly, by fitting the charging connector to the housing 20, signal terminals of the charging connector are inserted into the second cavity parts 25B respectively, and, accordingly, the second terminals 70 and the signal terminals of the charging connector are connected electrically.

The terminal mounting part 24 of the housing 20 has a holder fixing part 30. On the holder fixing part 30 of terminal mounting part 24, the rear holder 40 is mounted. The rear holder 40, to which the first terminals 60 and the second terminals 70 are assembled (assembly state), is mounted on the holder fixing part 30. On two sides and an upper portion of the holder fixing part 30, locking claws 31 are formed.

Figure 5:
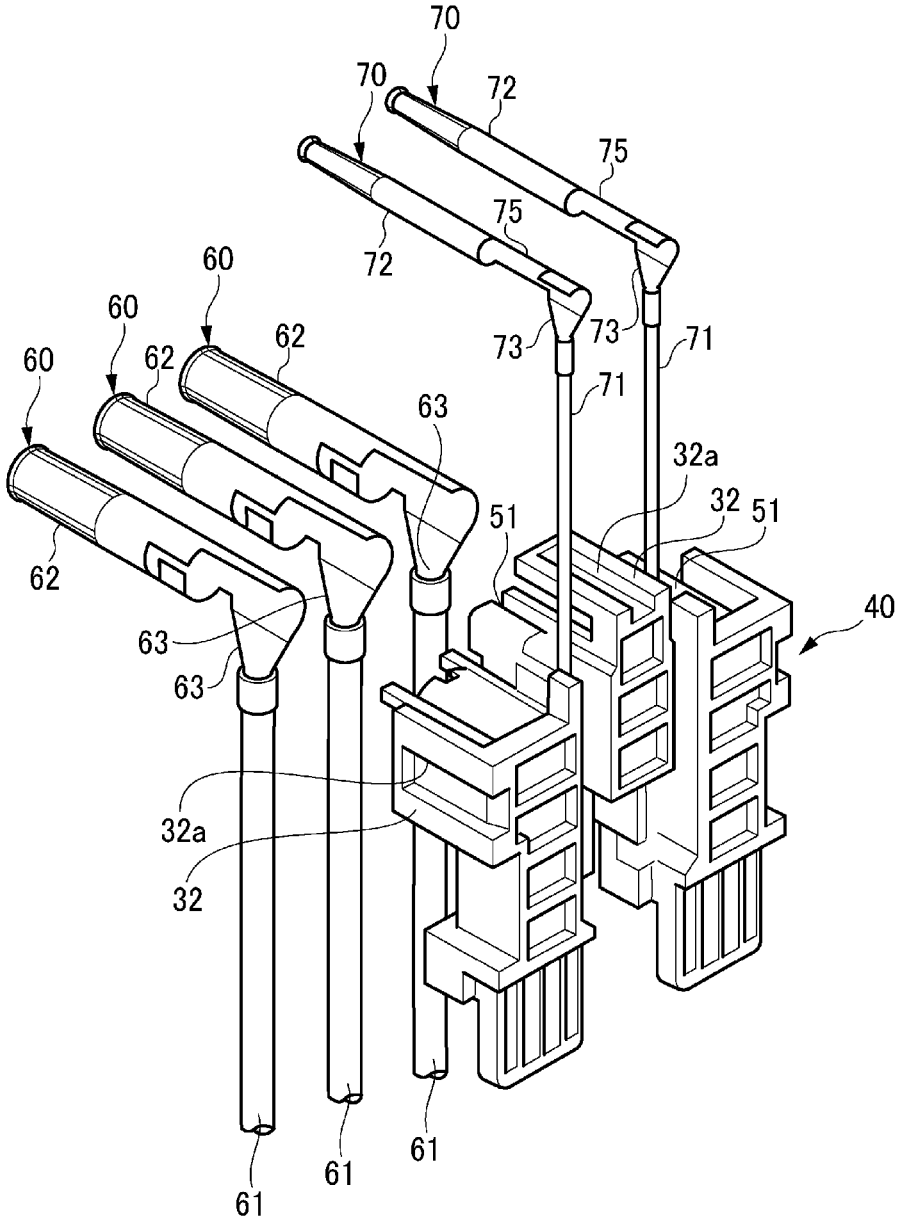
FIG. 5 is a perspective view of the rear holder, a first terminal and a second terminal when viewed from a rear side according to the embodiment.

FIG. 5 is a perspective view of the rear holder, the first terminals and the second terminals when viewed from a rear side.

As illustrated in FIG. 5, the first terminals 60 and the second terminals 70 are assembled in the rear holder 40. The power supply wires 61 are connected to the first terminals 60 respectively, and the signal wires 71 are connected to the second terminals 70 respectively.

The first terminals 60, for example, are made of conductive metallic material such as copper, copper alloy or the like. At a tip end side of each of the first terminals 60, an electric connection section 62 is provided, and at a rear end side of each of the first terminals 60, an electric wire connection section 63 is provided. The electric connection section 62 is connected to the power supply terminal of the charging connector electrically. The power supply wire 61 is electrically connected to the electric wire connection section 63 by way of crimping or the like. The power supply wire 61 connected to the electric wire connection section 63 is led out in a direction orthogonal to a direction in which the power supply terminal of the charging connector and the first terminal 60 are connected.

The second terminals 70, for example, are made of conductive metallic material such as copper, copper alloy or the like. At a tip end side of each of the second terminals 70, an electric connection section 72 is provided, and at a rear end side of each of the second terminals 70, an electric wire connection section 73 is provided. The electric connection section 72 is connected to the signal terminal of the charging connector electrically. The signal wire 71 is electrically connected to the electric wire connection section 73 by way of crimping or the like. The signal wire 71 connected to the electric wire connection section 73 is led out in a direction orthogonal to a direction in which the signal terminal of the charging connector and the second terminal 70 are connected. A notch part 75 is formed at a rear end side of the second terminal 70. The notch part 75 is formed in a recessed shape opened on a side.

Figure 6A:
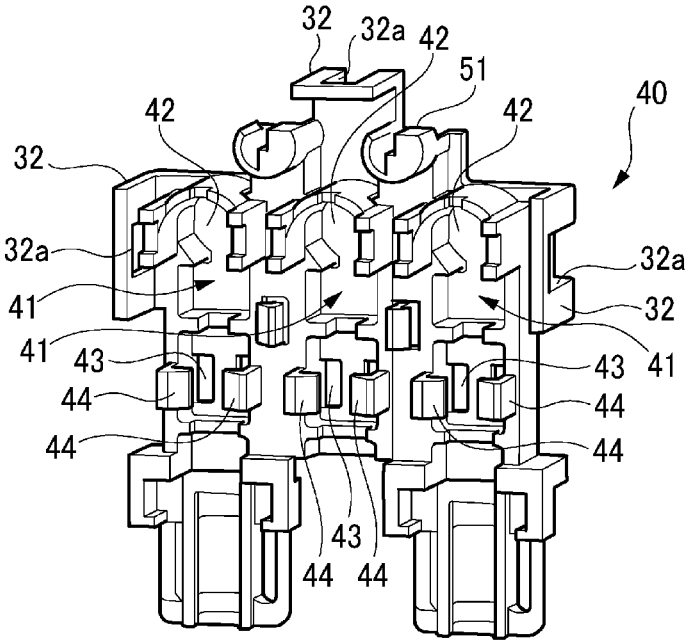
Figure 6B:
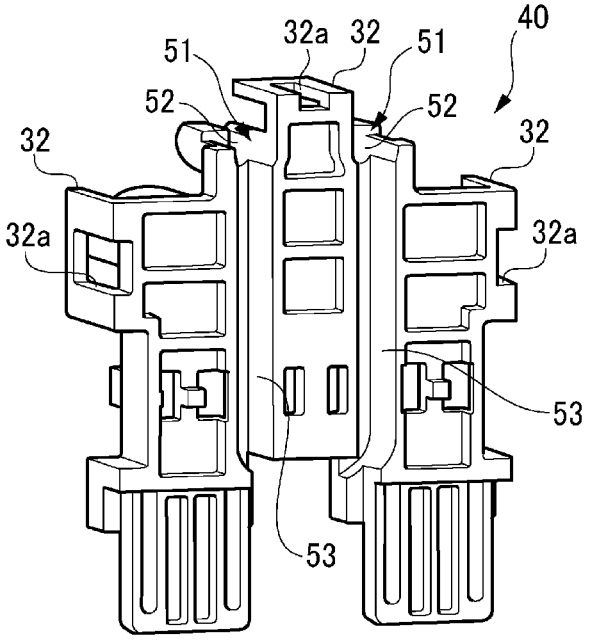
Figure 7:
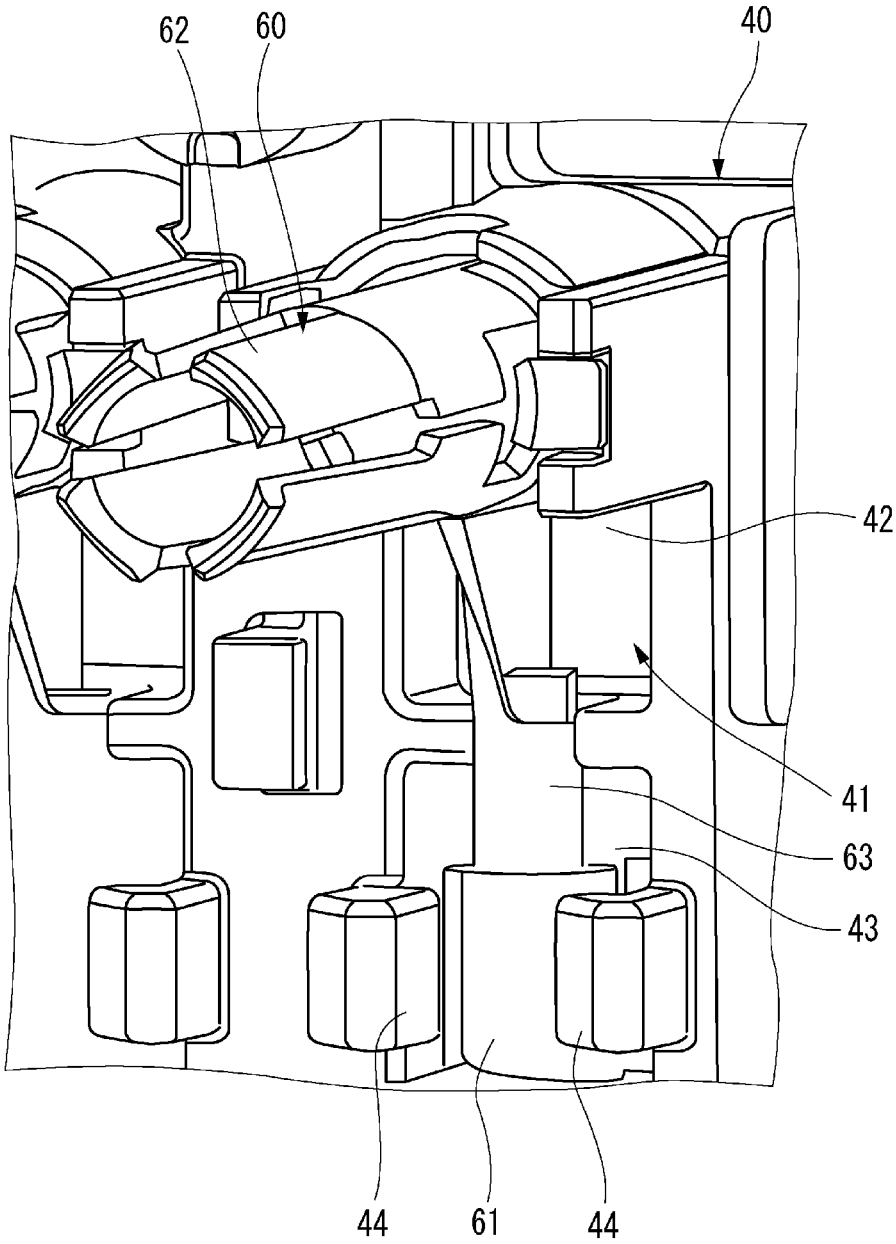
FIG. 7 is a perspective view of the first terminal accommodated in an accommodating recess part of a first terminal holding part.
Figure 8:
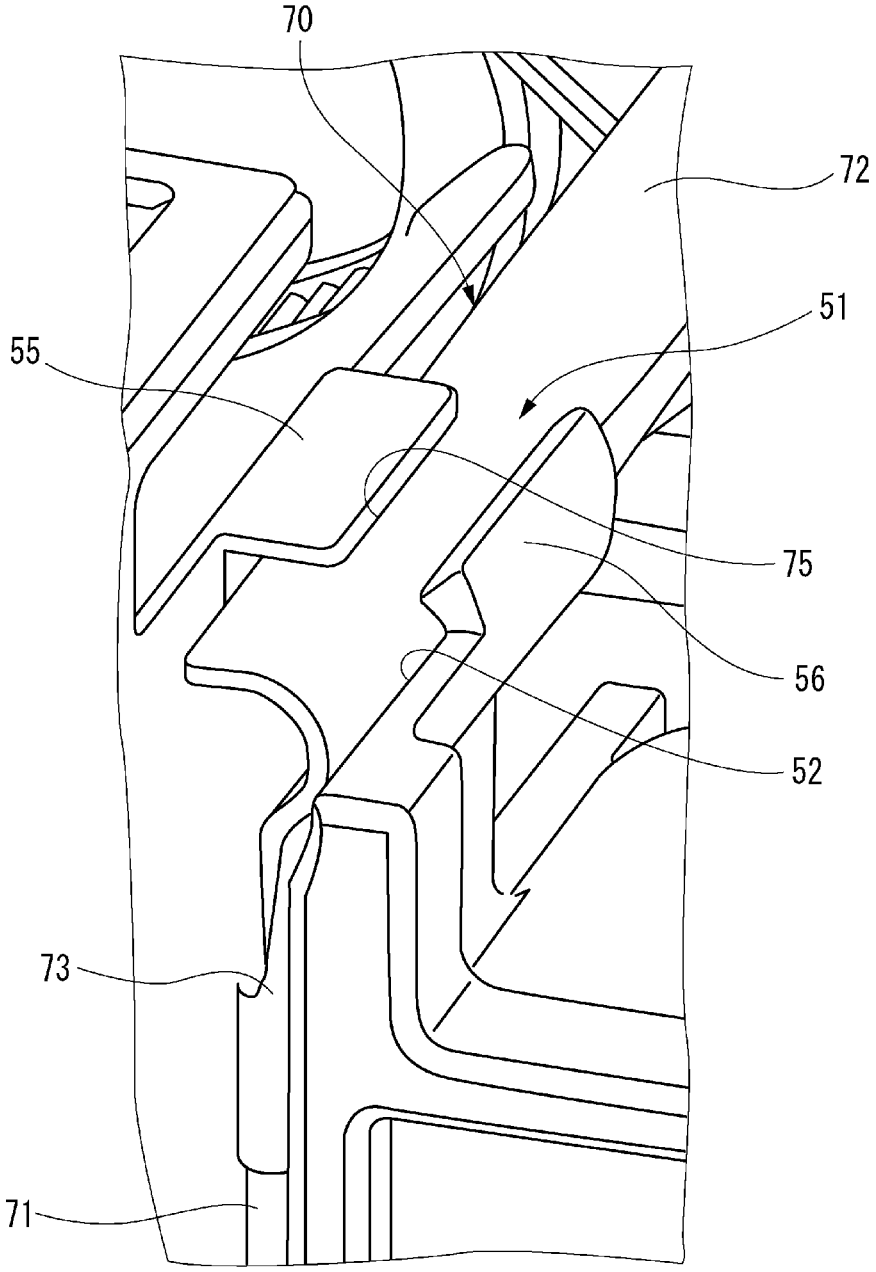
FIG. 8 is a perspective view of the second terminal accommodated in an accommodating recess part of a second terminal holding part.
Figure 9A:
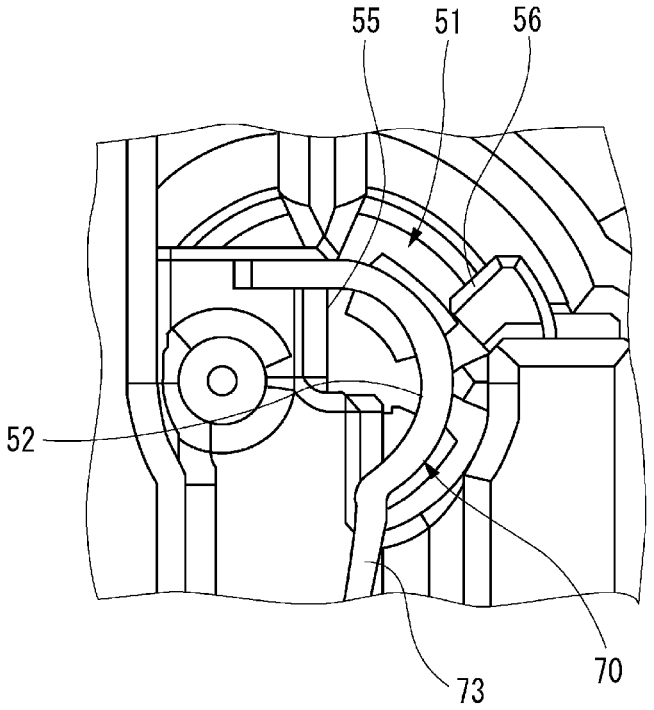
Figure 9B:
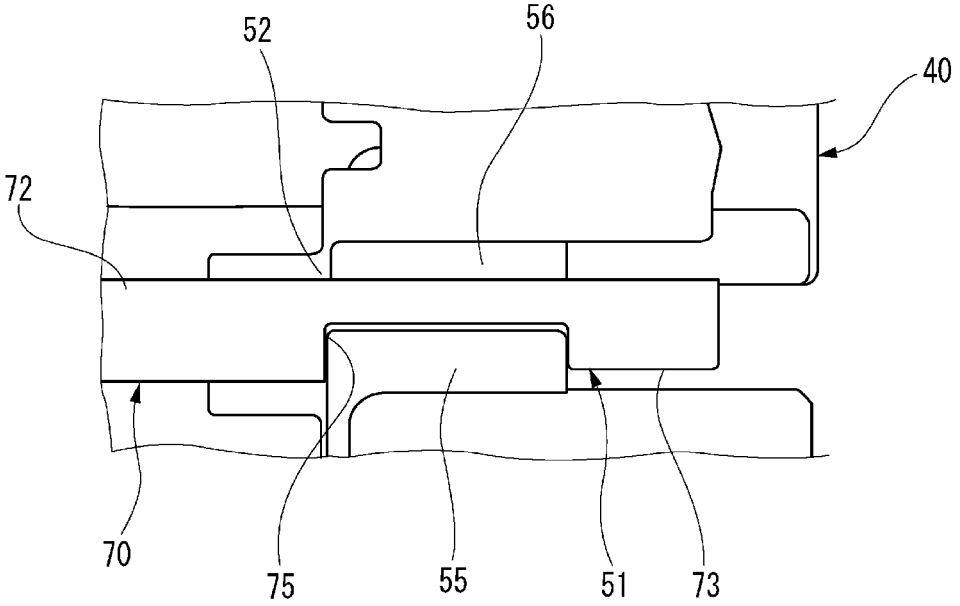

FIGS. 6A and 6B are views for illustrating the rear holder, in which FIG. 6A is a perspective view of the rear holder when viewed from a front side and FIG. 6B is a perspective view of the rear holder when viewed from a rear side. FIG. 7 is a perspective view of the first terminal accommodated in an accommodating recess part of a first terminal holding part. FIG. 8 is a perspective view of the second terminal accommodated in an accommodating recess part of a second terminal holding part. FIGS. 9A and 9B are views illustrating an accommodated state of the second terminal in the accommodating recess part of the second terminal holding part, in which FIG. 9A is a rear view of the accommodating recess part and FIG. 9B is a top view of the accommodating recess part.

As illustrated in FIG. 6A and FIG. 6B, the rear holder 40 is molded by synthetic resin, and has first terminal holding parts 41 and second terminal holding parts 51. In each of the first terminal holding parts 41, the first terminal 60 connected to the power supply wire 61 is held, and in each of the second terminal holding parts 51, the second terminal 70 connected to the signal wire 71 is held. On two sides and an upper portion of the rear holder 40, a locking piece 32 that has a locking hole 32*a* is formed.

The first terminal holding parts 41 are formed on a front side that is a mounting side of the rear holder 40 to be mounted on the housing 20. As illustrated in FIG. 7, each of the first terminal holding parts 41 is provided with an accommodating recess part 42 that is capable of accommodating the first terminal 60, and with a first electric wire accommodating groove 43 that is a power supply wire accommodating groove through which the power supply wire 61 passes. At both edges of the first electric wire accommodating groove 43, a pair of locking protrusions 44, which protrude towards each other, is formed.

In each of the first terminal holding parts 41, a rear end of the first terminal 60 is fitted from a front side and accommodated in the accommodating recess part 42. The power supply wire 61 connected to the first terminal 60 that is accommodated in the accommodating recess part 42, is accommodated in the first electric wire accommodating groove 43. The power supply wire 61 accommodated in the first electric wire accommodating groove 43 is locked by the locking protrusions 44 and coming-off from the front side is prevented. Since the power supply wire 61 is locked by the locking protrusions 44, a state of the first terminal 60 being held in the first terminal holding part 41 is maintained.

The second terminal holding parts 51 are formed at an upper portion of the rear holder 40. Each of the second terminal holding parts 51 is provided with an accommodating recess part 52 that is capable of accommodating the second terminal 70, and with a second electric wire accommodating groove 53 that is a signal wire accommodating groove through which the signal wire 71 passes. As illustrated in FIG. 8, FIG. 9A and FIG. 9B, at a side portion of the accommodating recess part 52, a locking convex part 55 that extends vertically is formed. Also, in the accommodating recess part 52, a pressing piece 56 is formed on a side opposite to the locking convex part 55.

In each of the second terminal holding parts 51, the second terminal 70 is fitted from an upper side and accommodated in the accommodating recess part 52. When the second terminal 70 is inserted into the accommodating recess part 52, the locking convex part 55 is engaged with the notch part 75 of the second terminal 70. Accordingly, movement of the second terminal 70 in a longitudinal direction thereof is restricted. Further, when the second terminal 70 is inserted into the accommodating recess part 52, the pressing piece 56 is elastically deformed toward an outer side by the electric wire connection section 73 of the second terminal 70. When the second terminal 70 is accommodated in the accommodating recess part 52, the pressing piece 56 that is elastically deformed returns to an inner side. Accordingly, a rear side that is an upper portion of the electric wire connection section 73 is pressed by the pressing piece 56 in a direction in which the second terminal 70 is fitted to the accommodating recess part 52, and thus coming-off of the second terminal 70 accommodated in the accommodating recess part 52 from an upper side is prevented. Further, a state of the second terminal 70 being held in the second terminal holding part 51 is maintained. The signal wire 71 connected to the second terminal 70 that is accommodated in the accommodating recess part 52, is accommodated in the second electric wire accommodating groove 53.

Next, a case where the connector 10 is assembled will be described.

Figure 10:
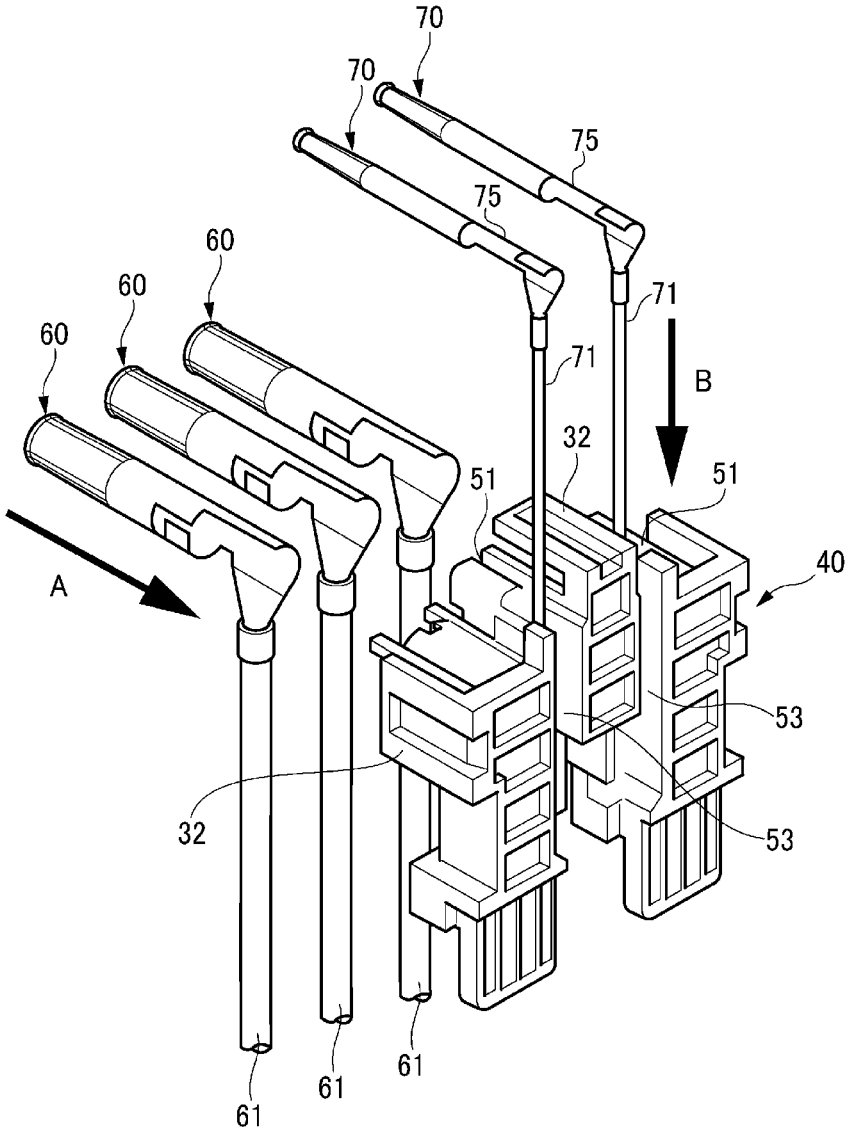
FIG. 10 is a perspective view of the rear holder, the first terminal and the second terminal when viewed from a rear side, illustrating a way of fitting the first terminal and the second terminal to the rear holder.
Figure 11:
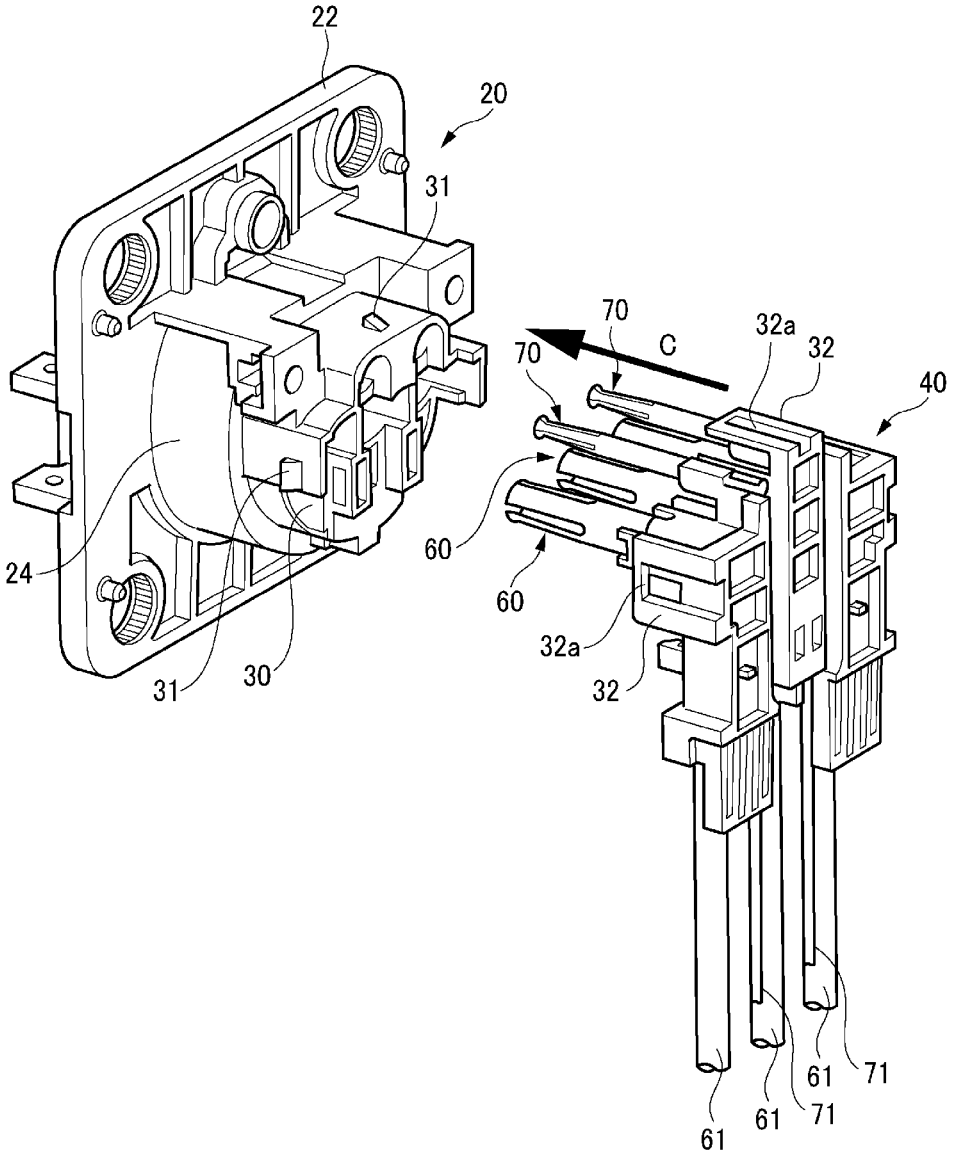
FIG. 11 is a perspective view of the housing and the rear holder when viewed from a rear side, illustrating a way of fitting the rear holder to the housing.

FIG. 10 is a perspective view of the rear holder, the first terminal and the second terminal when viewed from a rear side, illustrating a way of fitting the first terminal and the second terminal to the rear holder. FIG. 11 is a perspective view of the housing and the rear holder when viewed from a rear side, illustrating a way of fitting the rear holder to the housing.

As illustrated in FIG. 10, in assembling the connector, firstly, the first terminal 60 to which the power supply wire 61 is connected and the second terminal 70 to which the signal wire 71 is connected, are fitted to the rear holder 40.

At this time, each of the first terminals 60 is fitted toward the accommodating recess part 42 of the first terminal holding part 41 from a front side of the rear holder 40 (in the direction of arrow A in FIG. 10), with the electric connection section 62 facing forward, and is accommodated in the accommodating recess part 42. Further, the power supply wire 61 led out from the first terminal 60 in a direction orthogonal to an extending direction of the first terminal 60 is fitted into the first electric wire accommodating groove 43 formed on a front surface of the rear holder 40, and is locked by the locking protrusions 44. Accordingly, the first terminal 60 is held in the first terminal holding part 41 of the rear holder 40.

Further, in each of the second terminals 70, the signal wire 71 led out from the second terminal 70 in a direction orthogonal to an extending direction of the second terminal 70 is accommodated in the second electric wire accommodating groove 53, with the electric connection section 72 facing forward. In this state, the second terminal 70 is fitted toward the accommodating recess part 52 of the second terminal holding part 51 from an upper side of the rear holder 40 (in the direction of arrow B in FIG. 10), and is accommodated in the accommodating recess part 52. Accordingly, the locking convex part 55 is engaged with the notch part 75 of the second terminal 70, and coming-off of the second terminal 70 from the upper side is prevented by pressing the electric wire connection section 73 with the pressing piece 56. Accordingly, the second terminal 70 is held in the second terminal holding part 51 of the rear holder 40.

As illustrated in FIG. 11, when the first terminals 60 and the second terminals 70 are fitted on the rear holder 40, the rear holder 40 in an assembled state (assembly state) is brought close to the terminal mounting part 24 of the housing 20 from a rear side, toward the holder fixing part 30 (in the direction of arrow C in FIG. 11).

Accordingly, the electric connection sections 62 of the first terminals 60 are inserted into the first cavity parts 25A of the housing 20 respectively, and the electric connection sections 72 of the second terminals 70 are inserted into the second cavity parts 25B of the housing 20. Further, the locking claw 31 of the holder fixing part 30 is locked in the locking piece 32 of the rear holder 40, and the rear holder 40 is fixed to the holder fixing part 30.

Here, a connector according to a reference example will be described.

Figure 12:
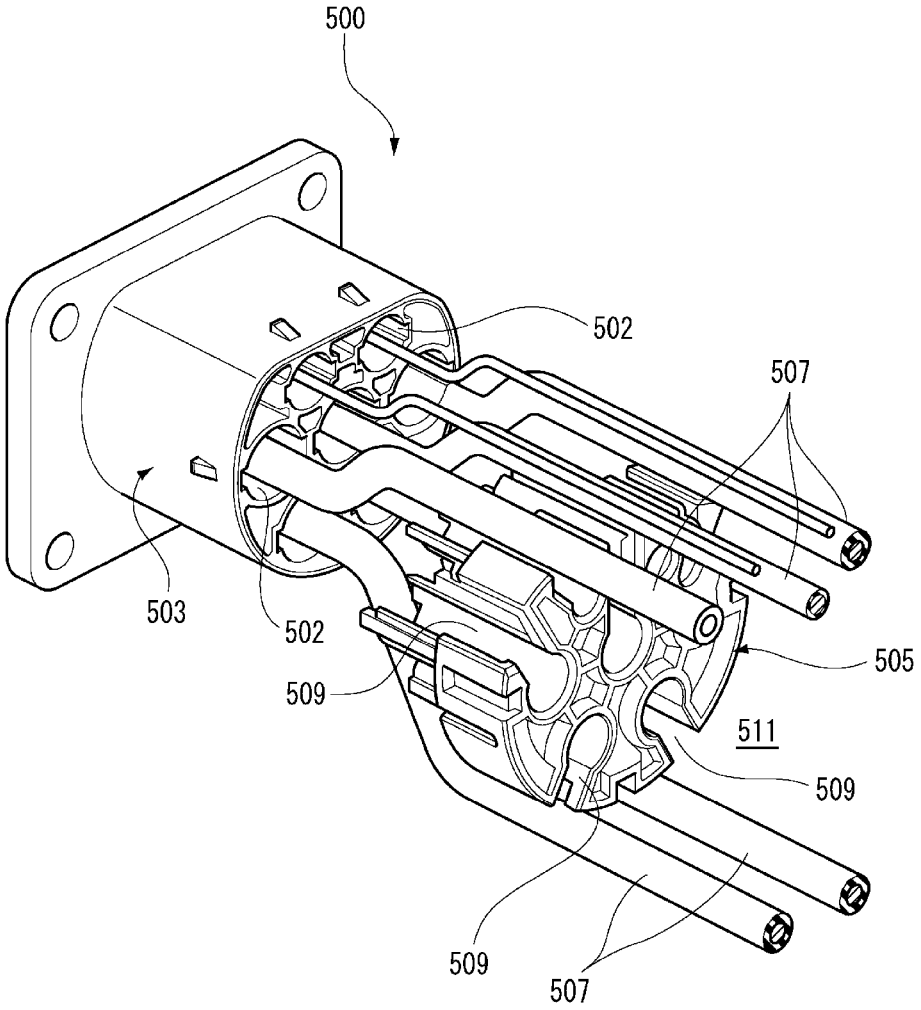
FIG. 12 is a perspective view of a connector according to a reference example viewed from a rear side of a housing before a rear holder with set terminals is inserted.
Figure 13:
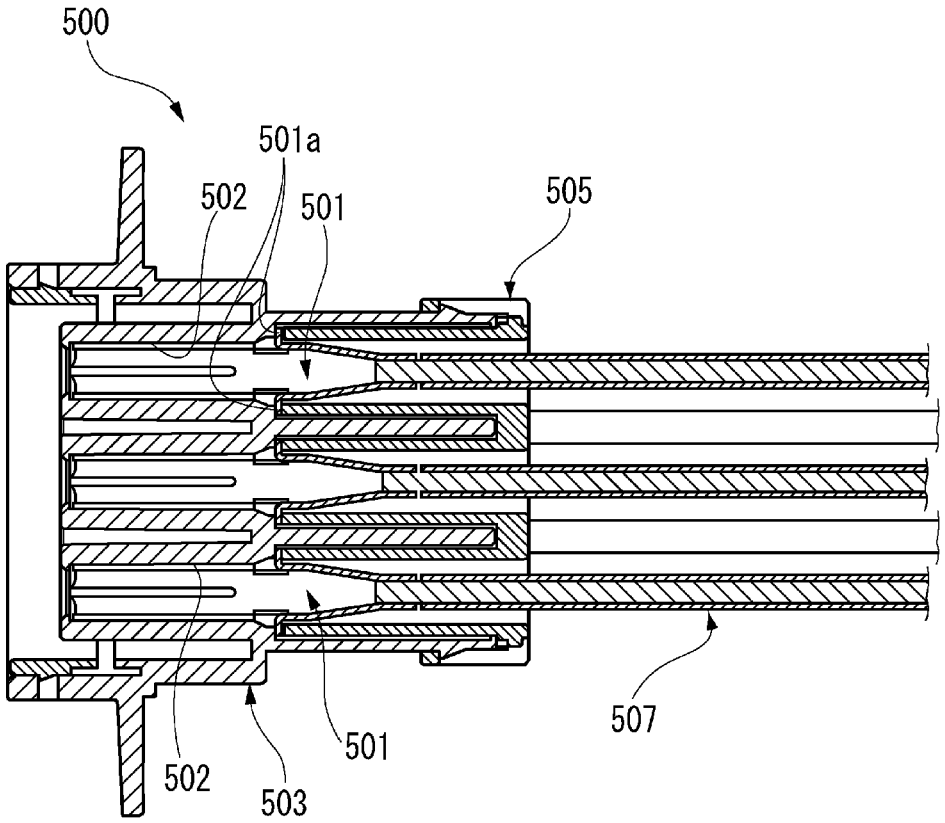
FIG. 13 is a horizontal sectional view of the connector as illustrated in FIG. 12.

FIG. 12 is a perspective view of the connector according to the reference example viewed from a rear side of a housing before a rear holder with set terminals is inserted. FIG. 13 is a horizontal sectional view of the connector as illustrated in FIG. 12.

As illustrated in FIG. 12 and FIG. 13, a connector 500 according to the reference example includes a plurality of terminals 501, a housing 503 and a rear holder 505. In the housing 503, a plurality of terminal accommodating chambers 502 are formed, and a plurality of terminals 501 are accommodated in the terminal accommodating chambers 502. Electric wires 507 are electrically connected to rear ends of the terminals 501 respectively, and the electric wires 507 are led out from the rear end of the terminal 501 along an axial direction of the terminals 501. Each of the terminals 501 is provided with a vane part 501*a* that extends toward an outer peripheral side, and is held by fitting the rear holder 505 to the housing 503 and sandwiching the vane part 501*a* between the housing 503 and the rear holder 505. Slits 509 for setting the electric wires 507 connected to the terminals 501 respectively are formed in the rear holder 505.

When assembling the connector 500, firstly, the plurality of terminals 501 are inserted into the plurality of terminal accommodating chambers 502 of the housing 503, respectively. Next, a space 511 is formed by placing a plurality of electric wires 507 vertically. Next, the rear holder 505 is passed through the formed space 511. The electric wires 507 are set in the slits 509 of the rear holder 505. Finally, as illustrated in FIG. 13, the rear holder 505 is mounted on a rear end of the housing 503, and the vane parts 501*a* of the terminals 501 are locked by being sandwiched between the housing 503 and the rear holder 505, and the assembling of the connector 500 is completed.

However, in the connector 500 according to the reference example, the procedure for fitting the rear holder 505 to the housing 503 so as to lock the terminals 501 is complicated, and additionally, since the electric wires 507 led out from the rear ends of the terminals 501 along the axial direction of the terminals 501 is entangled, the work becomes difficult. Further, the terminals 501 cannot be locked to the housing 503 until the rear holder 505 is mounted on the housing 503, and thus there is a possibility that the terminals 501 deviates from a proper position. In a state where the terminals 501 deviate from the proper position, when the rear holder 505 is fitted, a terminal holding force cannot be obtained, and there is a possibility that a defective assembly occurs. Moreover, holding state of the terminal s501 accommodated in the terminal accommodating chambers 502 cannot be observed visually, discovery of the defective assembly is difficult. Further, since the terminals 501 are held by sandwiching the vane part 501*a* of the terminal 501 between two components of the housing 503 and the rear holder 505, if the dimensional accuracy of the housing 503 and the rear holder 505 and the machining accuracy of the vane part 501*a* formed by bending is low, there is a possibility that backlash occurs in the terminals 501 inside the terminal accommodating chambers 502.

In contrast, according to the connector 10 of the embodiment, each of the first terminals 60 can be easily held in the rear holder 40 by locking the power supply wire 61 that extends from the first terminal 60 using the locking protrusion 44. Further, the locking convex part 55 is engaged with the notch part 75 of each of the second terminals 70, and the rear side of each of the second terminals 70 is pressed by the pressing piece 56 in the direction in which the second terminal 70 is fitted to the accommodating recess part 52 of the second terminal holding part 51, so that the terminal 70 can be easily and securely held in the rear holder 40. Further, the state of the first terminals 60 being held in the first terminal holding parts 41 is maintained by the locking protrusions 44, and the state of the second terminals 70 being held in the second terminal holding parts 51 is maintained by the locking convex part 55 and the pressing piece 56.

Therefore, the rear holder 40 can be mounted on the housing 20, in a state where the first terminals 60 and the second terminals 70 are held in the first terminal holding parts 41 and the second terminal holding parts 51 respectively. Moreover, when the rear holder 40 is fitted to the housing 20, coming-off of the first terminals 60 and the second terminals 70 from the rear holder 40 can be prevented. Thus, the first terminals 60 and the second terminals 70 can be held without backlash, and assembling workability can be improved. Further, holding state of the first terminals 60 and the second terminals 70 in the first terminal holding parts 41 and the second terminal holding parts 51 respectively can be observed visually, and the defective assembly can be easily prevented. Moreover, the first terminals 60 and the second terminals 70 are held in the rear holder 40 along the direction in which the first terminals 60 and the second terminals 70 are connected to mating terminals thereof, orthogonal to the direction in which the power supply wire 61 and the signal wire 71 are led out. Therefore, the power supply wires 61 and the signal wires 71 that extend from the first terminals 60 and the second terminals 70 respectively do not get entangled with each other, and the first terminals 60 and the second terminals 70 can be held in the first terminal holding parts 41 and the second terminal holding parts 51 of the rear holder 40 respectively.

Further, by fitting the first terminals 60 to the accommodating recess parts 42 of the first terminal holding parts 41 respectively and fitting the second terminals 70 to the accommodating recess parts 52 of the second terminal holding parts 51 respectively, the first terminals 60 and the second terminals 70 can be easily held in the rear holder 40. Particularly, the accommodating recess parts 42 of the first terminal holding parts 41 are formed on the mounting side of the rear holder 40 to be mounted on the housing 20. Therefore, when being connected to the charging connector that is the mating connector, a force, which acts on the first terminals 60 toward a rear side in the direction in which the first terminals 60 is connected to the mating terminal, can be received by the rear holder 40.

Moreover, since the power supply wires 61 and the signal wires 71 that extend from the first terminals 60 and the second terminals 70 respectively are accommodated in the first electric wire accommodating grooves 43 and the second electric wire accommodating grooves 53 respectively, stagnation of the assembling operations due to stretching of the power supply wire 61 and the signal wire 71 is eliminated and even better assembling workability can be ensured.

It is to be noted that the invention is not limited to the above described embodiment, and various modifications, improvements and the like can be appropriately made. In addition, materials, shapes, dimensions, numerals, disposition locations, and the like of each component in the above-described embodiment are arbitrary as long as the objects of the invention can be achieved, and are not limited.

Further, characteristics of the embodiments of the connector according to the invention described above are summarized briefly in the following [1] to [4], respectively.

[1] a Connector Includes:

a terminal (first terminal 60, second terminal 70) configured to be connected to a mating terminal, and having an electric wire (power supply wire 61, signal wire 71) led out in a direction orthogonal to a connection direction in which the terminal is connected to the mating terminal;

a housing (20), having a cavity part (first cavity part 25A, second cavity part 25B) configured to accommodate the terminal (first terminal 60, second terminal 70); and a rear holder (40) having a terminal holding part (first terminal holding part 41, second terminal holding part 51) configured to hold the terminal (first terminal 60, second terminal 70), wherein the terminal (first terminal 60, second terminal 70) is accommodated in the cavity part (first cavity part 25A, second cavity part 25B) when the rear holder is assembled to the housing (20);

wherein the rear holder (40) includes a locking mechanism (locking protrusion 44, locking convex part 55, pressing piece 56) that locks the terminal (first terminal 60, second terminal 70) or the electric wire (power supply wire 61, signal wire 71) and that maintain a state of the terminal (first terminal 60, second terminal 70) being held in the terminal holding part (first terminal holding part 41, second terminal holding part 51).

[2] The connector according to [1], wherein the terminal has a first terminal (60) and a second terminal (70), and wherein the terminal holding part has:

a first terminal holding part (41) that is provided on an assembling side of the rear holder (40) to be assembled to the housing (20) and has an accommodating recess part (42) into which the first terminal (60) is fitted; and a second terminal holding part (51) that has an accommodating recess part (52) into which the second terminal (70) is fitted in a direction orthogonal to the connection direction.

[3] The connector according to [2], wherein the locking mechanism includes a first locking mechanism that locks the first terminal (60) fitted into the first terminal holding part (41), and a second locking mechanism that locks the second terminal (70) fitted into the second terminal holding part (51);

wherein the first locking mechanism includes a locking protrusion (44) that locks the electric wire (power supply wire 61) extending from the first terminal (60); and wherein the second locking mechanism includes:

a locking convex part (55) that is engaged with a notch part (75) provided in the second terminal (70) in a direction orthogonal to the connection direction; and a pressing part (56) that presses a rear part of the second terminal (70) in a direction in which the second terminal (70) is fitted to the accommodating recess part (52) of the second terminal holding part (51).

[4] The connector according to [2] or [3], wherein the first terminal holding part (41) has a first electric wire accommodating groove (43) that accommodates one of the electric wires (power supply wire 61) extending from the first terminal (60), and the second terminal holding part (51) has a second electric wire accommodating groove (53) that accommodates another electric wire (signal wire 71) extending from the second terminal (70).

What is claimed is:

1. A connector, comprising:

a terminal configured to be connected to a mating terminal, and having an electric wire led out in a direction orthogonal to a connection direction in which the terminal is connected to the mating terminal;

a housing having a cavity part configured to accommodate the terminal; and a rear holder having a terminal holding part configured to hold the terminal, wherein the terminal is accommodated in the cavity part when the rear holder is assembled to the housing; and wherein the rear holder includes a locking mechanism that locks the terminal or the electric wire and that maintains a state of the terminal being held in the terminal holding part, wherein the terminal has a first terminal and a second terminal; and wherein the terminal holding part has:

a first terminal holding part that is provided on an assembling side of the rear holder to be assembled to the housing and has an accommodating recess part into which the first terminal is fitted; and a second terminal holding part that has an accommodating recess part into which the second terminal is fitted in a direction orthogonal to the connection direction, and wherein the locking mechanism includes a first locking mechanism that locks the first terminal fitted into the first terminal holding part, and a second locking mechanism that locks the second terminal fitted into the second terminal holding part;

wherein the first locking mechanism includes a locking protrusion that locks the electric wire extending from the first terminal; and wherein the second locking mechanism includes:

a locking convex part that is engaged with a notch part provided in the second terminal in a direction orthogonal to the connection direction; and a pressing part that presses a rear part of the second terminal in a direction in which the second terminal is fitted to the accommodating recess part of the second terminal holding part.

2. The connector according to claim 1, wherein the first terminal holding part has a first electric wire accommodating groove that accommodates the electric wire extending from the first terminal, and the second terminal holding part has a second electric wire accommodating groove that accommodates another electric wire extending from the second terminal.

* * * * *